US007874282B2

(12) United States Patent
Ghelardi et al.

(10) Patent No.: US 7,874,282 B2
(45) Date of Patent: Jan. 25, 2011

(54) COUPLING DEVICE AND FUEL SUPPLY ARRANGEMENT

(75) Inventors: Tiziano Ghelardi, S. Gruliako T. (IT); Massimo Latini, Empoli (IT); Daniel Marc, Livorno (IT)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 12/042,535

(22) Filed: Mar. 5, 2008

(65) Prior Publication Data

US 2008/0216798 A1 Sep. 11, 2008

(30) Foreign Application Priority Data

Mar. 8, 2007 (EP) ..... 07004823

(51) Int. Cl.
*F02M 61/14* (2006.01)
*F02M 69/46* (2006.01)

(52) U.S. Cl. ..... 123/470; 123/456

(58) Field of Classification Search ..... 123/468, 123/469, 470, 456; 285/142.1, 205, 206, 285/207, 208, 209
See application file for complete search history.

(56) References Cited

U.S. PATENT DOCUMENTS

| | | | | |
|---|---|---|---|---|
| 2,522,757 | A * | 9/1950 | Larson | 119/71 |
| 2,917,267 | A * | 12/1959 | Riddle | 248/507 |
| 4,593,940 | A * | 6/1986 | Wilder | 285/142.1 |
| 5,394,850 | A | 3/1995 | Murphy et al. | 123/470 |
| 5,951,059 | A * | 9/1999 | Kitamura | 285/24 |
| 6,148,797 | A * | 11/2000 | Gmelin | 123/456 |
| 6,167,903 | B1 * | 1/2001 | Newman | 137/351 |
| 6,431,151 | B1 | 8/2002 | Gmelin | 123/470 |
| 6,874,477 | B1 * | 4/2005 | Lorraine et al. | 123/468 |
| 6,889,660 | B2 * | 5/2005 | Usui et al. | 123/456 |
| 7,188,611 | B2 * | 3/2007 | Schmieder | 123/469 |
| 7,305,969 | B2 * | 12/2007 | Ricco et al. | 123/456 |
| 2002/0152994 | A1 * | 10/2002 | Kurtenbach et al. | 123/470 |
| 2003/0154961 | A1 * | 8/2003 | Liskow | 123/470 |
| 2004/0118382 | A1 * | 6/2004 | Usui et al. | 123/456 |
| 2004/0194761 | A1 * | 10/2004 | Ando et al. | 123/456 |
| 2004/0244776 | A1 * | 12/2004 | Aota | 123/470 |
| 2006/0021601 | A1 * | 2/2006 | Schmieder | 123/468 |
| 2006/0180125 | A1 * | 8/2006 | Kaishio | 123/456 |
| 2007/0006848 | A1 * | 1/2007 | Ricco et al. | 123/456 |
| 2007/0246016 | A1 * | 10/2007 | Scheffel et al. | 123/470 |
| 2009/0145407 | A1 * | 6/2009 | Edoardo et al. | 123/470 |

FOREIGN PATENT DOCUMENTS

| | | |
|---|---|---|
| EP | 1 094 217 A2 | 4/2001 |
| EP | 1 172 551 A2 | 1/2002 |
| EP | 1 752 655 A1 | 2/2007 |
| WO | WO 02/29241 A2 | 4/2002 |

* cited by examiner

*Primary Examiner*—Thomas Moulis
*Assistant Examiner*—Sizo B Vilakazi
(74) *Attorney, Agent, or Firm*—King & Spalding L.L.P.

(57) ABSTRACT

A coupling device (30) for hydraulically coupling a fuel injector (20) to a fuel rail (18) of a combustion engine (22) has a fuel injector cup (38) being designed to engage a fuel inlet portion (26) of the fuel injector (20), and a tube (32) with a first end (34*a*) and a second end (34*b*), the first end (34*a*) being coupable to the fuel rail (18) and the second end (34*b*) being coupled to the fuel injector cup (38).

20 Claims, 3 Drawing Sheets

COUPLING DEVICE AND FUEL SUPPLY ARRANGEMENT

CROSS-REFERENCE TO RELATED APPLICATIONS

This application claims priority to European Patent Application Number 07004823 filed on Mar. 8, 2007, and which is incorporated herein by reference in its entirety.

TECHNICAL FIELD

The invention relates to a coupling device for coupling a fuel injector to a fuel rail of a combustion engine and a fuel supply arrangement.

BACKGROUND

Fuel injectors are in wide spread use, in particular for internal combustion engines where they may be arranged in order to dose fuel into an intake manifold of the internal combustion engine or directly into the combustion chamber of a cylinder of the internal combustion engine. Fuel can be supplied to the internal combustion engine by the fuel injector.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a fuel rail. The fuel injectors can be coupled to the fuel rail of the internal combustion engine in different manners.

Known fuel rails comprise a hollow body with recesses in form of fuel injector cups, wherein the fuel injectors are arranged. The connection of the fuel injectors to the fuel injector cups that supply the fuel from a fuel tank via a low or high-pressure fuel pump needs to be very precise to get a correct injection quantity and to provide an adequate sealing and orientation.

SUMMARY

A coupling device can be created that is simply to be manufactured and which facilitates a reliable and precise connection between the fuel injector and the fuel injector cup.

According to an embodiment, a coupling device for hydraulically coupling a fuel injector to a fuel rail of a combustion engine may comprise a fuel injector cup being designed to engage a fuel inlet portion of the fuel injector, and a tube with a first end and a second end, the first end being coupable to the fuel rail and the second end being coupled to the fuel injector cup.

According to a further embodiment, the tube may be rigid. According to a further embodiment, a coupling nut may be coupled to the first end of the tube and may be designed to sealingly interact with the fuel rail. According to a further embodiment, the first end of the tube can be brazed or welded to the fuel rail. According to a further embodiment, the fuel injector cup can be brazed or welded to the second end of the tube. According to a further embodiment, the fuel injector cup may comprise a protrusion, the protrusion being designed to enable a rigid coupling of the fuel injector cup to a cylinder head of the combustion engine. According to a further embodiment, the fuel injector cup may comprise a plurality of protrusions circumferentially distributed relative to a central longitudinal axis of the fuel injector cup and extending in radial direction relative to the central longitudinal axis of the fuel injector cup. According to a further embodiment, the protrusions may comprise orifices being designed to engage fixing elements, the fixing elements being designed to rigidly couple the fuel injector cup to the cylinder head of the combustion engine. According to a further embodiment, the fixing elements may be screws engaging the cylinder head of the combustion engine.

According to another embodiment, a fuel supply arrangement may comprise such a coupling device and further comprise a fuel rail being hydraulically coupled to the coupling device.

BRIEF DESCRIPTION OF THE DRAWINGS

Exemplary embodiments of the invention are explained in the following with the aid of schematic drawings. These are as follows.

Elements of the same design and function that occur in different illustrations are identified by the same reference character.

DETAILED DESCRIPTION

Figure 1:
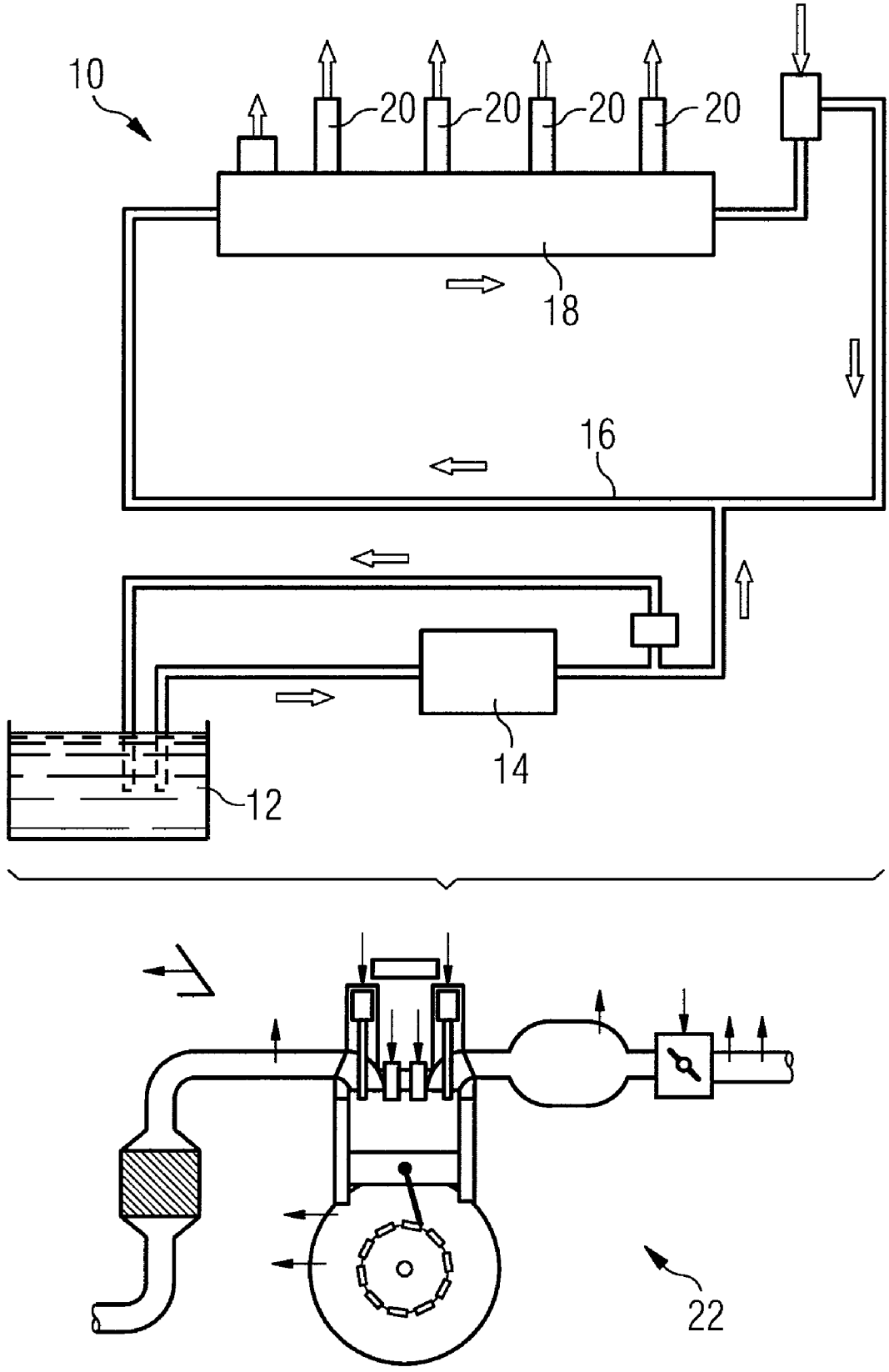
FIG. 1 an internal combustion engine with a fuel rail in a schematic view.

According to a first aspect, a coupling device for hydraulically coupling a fuel injector to a fuel rail of a combustion engine may comprise a fuel injector cup being designed to engage a fuel inlet portion of the fuel injector, and a tube with a first end and a second end, the first end being coupable to the fuel rail and the second end being coupled to the fuel injector cup.

This has the advantage that the hydraulic coupling between the fuel injector and the fuel rail can obtain a high flexibility for arbitrary positions of the fuel injector relative to the fuel rail. Furthermore, it is possible to obtain a precise orientation of the fuel injector cup relative to the fuel injector. Consequently, the fuel can be precisely dosed and targeted by the fuel injector.

According to a further embodiment of the coupling device the tube may be rigid. By this a robust coupling between the fuel rail and the fuel injector under a well-defined geometry and position is possible.

According to a further embodiment of the coupling device a coupling nut may be coupled to the first end of the tube and is designed to sealingly interact with the fuel rail. By this a simple coupling between the tube and the fuel rail can be obtained.

According to a further embodiment of the coupling device the first end of the tube may be brazed or welded to the fuel rail. This has the advantage that a simple and robust coupling between the tube and the fuel rail is possible.

According to a further embodiment of the coupling device the fuel injector cup may be brazed or welded to the second end of the tube. By this it is possible to obtain a robust means for a rigid coupling of the fuel injector cup to the tube.

According to a further embodiment of the coupling device the fuel injector cup may comprise a protrusion, the protrusion being designed to enable a rigid coupling of the fuel injector cup to a cylinder head of the combustion engine. This enables that the fuel injector cup is rigidly coupable to the cylinder head by simple means. Additionally, the fuel injector can be fixed in the cylinder head in a secure manner.

According to a further embodiment, the fuel injector cup may comprise a plurality of protrusions circumferentially distributed relative to a central longitudinal axis of the fuel injector cup and extends in radial direction relative to the central longitudinal axis of the fuel injector cup. This makes it possible to rigidly couple the fuel injector cup to the cylinder head by a robust mean.

According to a further embodiment, the protrusions may comprise orifices being designed to engage fixing elements, the fixing elements being designed to rigidly couple the fuel injector cup to the cylinder head of the combustion engine. This enables a rigid coupling of the fuel injector cup to the cylinder head by robust means.

According to a further embodiment, the fixing elements may be screws engaging the cylinder head of the combustion engine. This gives the possibility to couple the fuel injector cup rigidly to the cylinder head by robust means.

According to a second aspect, a fuel supply arrangement may comprise a coupling device according to the first aspect and a fuel rail being hydraulically coupled to the coupling device.

A fuel feed device 10 is assigned to an internal combustion engine 22 (FIG. 1). It includes a fuel tank 12 that is connected via a first fuel line to a fuel pump 14. The output of the fuel pump 14 is connected to a fuel inlet 16 of a fuel rail 18. Fuel injectors 20 are connected to the fuel rail 18. The fuel is fed to the fuel injectors 20 via the fuel rail 18. The fuel injectors 20 have a sealed connection to the fuel rail 18.

Figure 2:
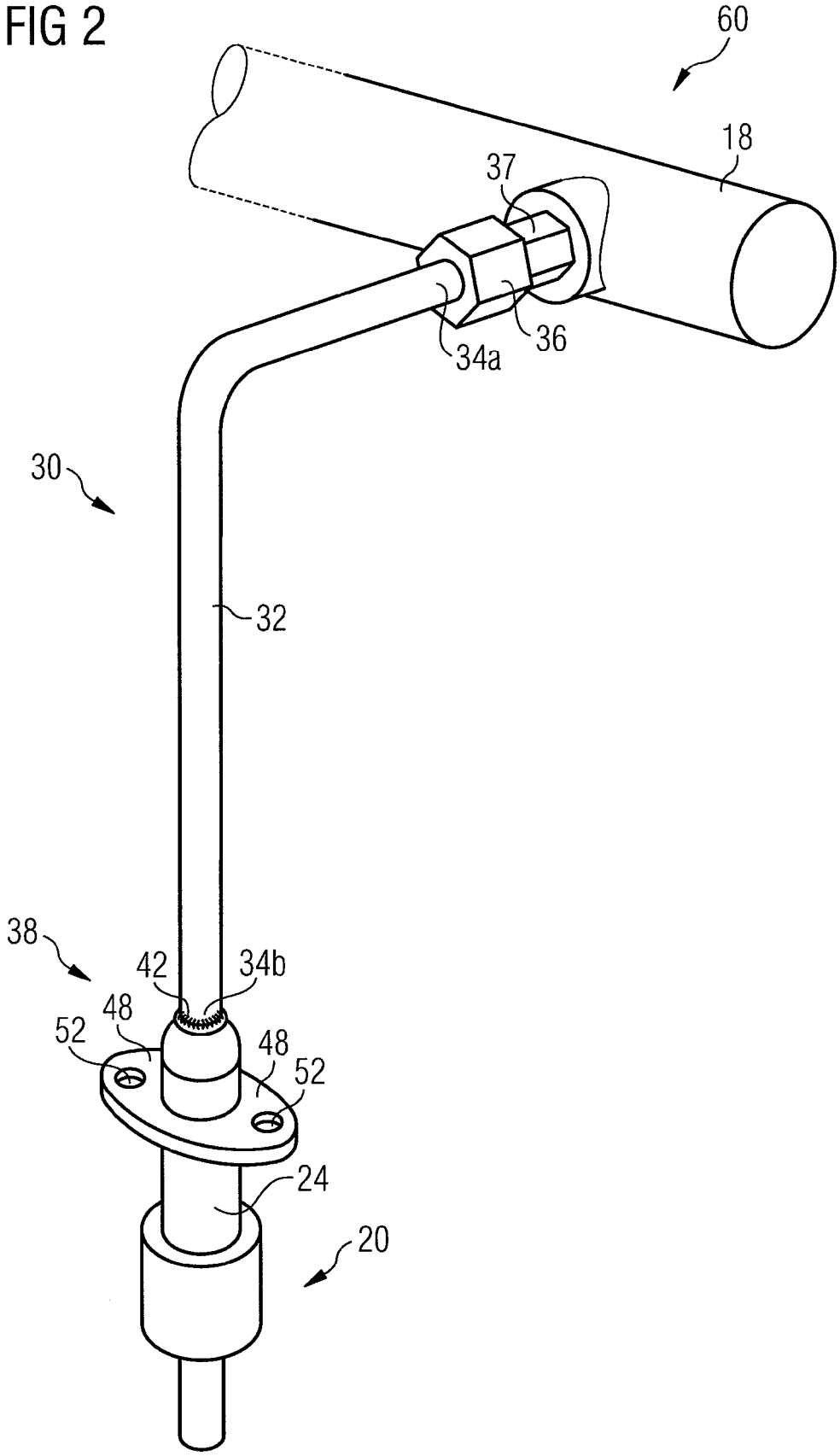
FIG. 2 an embodiment of a fuel supply arrangement with a coupling device and a fuel injector in a perspective view, and FIG. 3 a longitudinal section through an embodiment of the coupling device and the fuel injector.

A fuel supply arrangement 60 comprises the fuel rail 18 and a coupling device 30. The coupling device 30 has a tube 32 and a fuel injector cup 38 and is arranged between the fuel rail 18 and the fuel injector 20 to hydraulically couple the fuel injector 20 to the fuel rail 18 (FIG. 2). The fuel injector 20 is suitable for injecting fuel into a gasoline engine.

The tube 32 of the coupling device 30 has a first end 34*a* and a second end 34*b*. The first end 34*a* of the tube 32 is coupled to the fuel rail 18 by a metal to metal connection comprising a coupling nut 36 with an inner thread and a bolt 37 with an outer thread. The bolt 37 is rigidly coupled to the fuel rail 18 and the coupling nut 36 is coupled to the bolt 37 by a screw connection. The fuel injector cup 38 is coupled to the second end 34*b* of the tube 32 by a weld seam 42.

Figure 3:
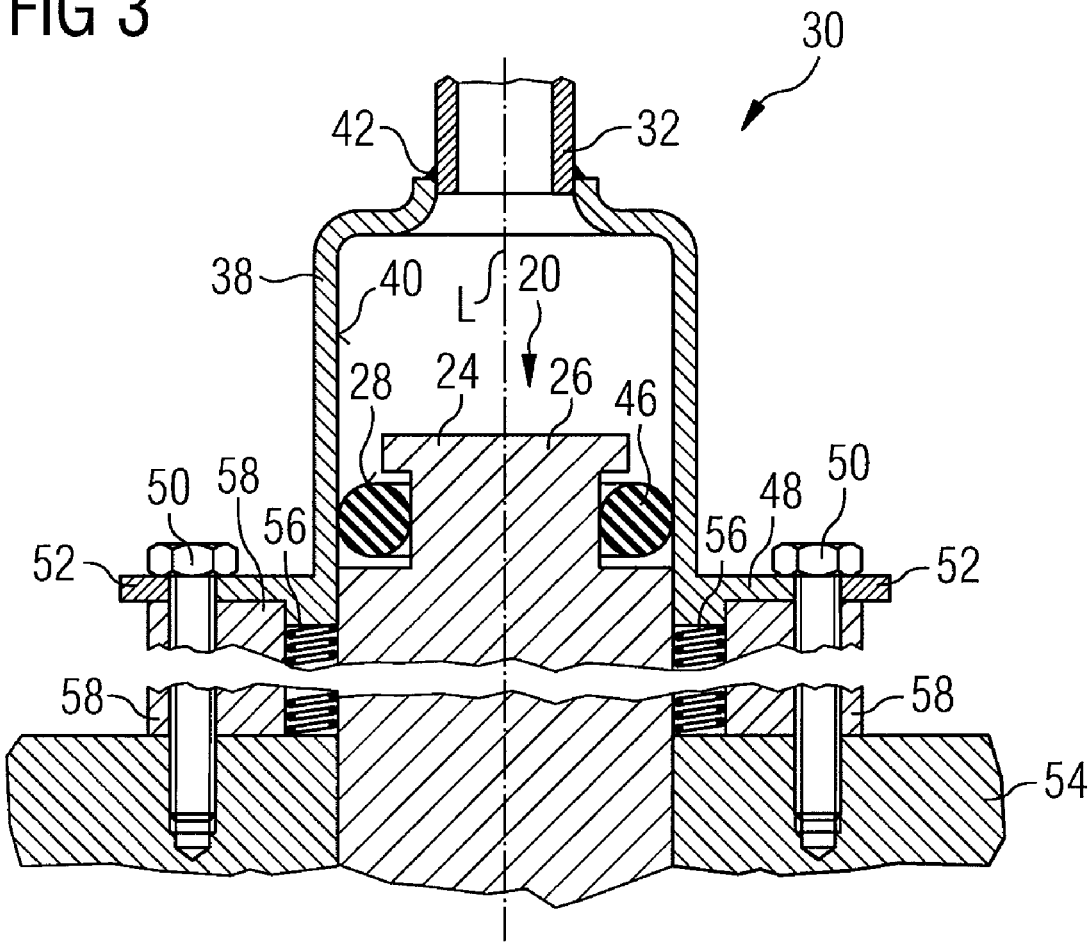

FIG. 3 shows the coupling device 30 and the fuel injector 20 in detail.

The fuel injector 20 has a fuel injector body 24 with a fuel inlet portion 26, a not shown fuel outlet portion and an outer surface 28.

The fuel injector cup 38 is cup-shaped with a central longitudinal axis L and is designed to receive the fuel injector body 24 of the fuel injector 20. In the shown embodiment an inner surface 40 of the fuel injector cup 38 is designed as a smooth wall. Between the fuel injector body 24 and the fuel injector cup 38 a sealing ring 46 is arranged to obtain a good sealing between the fuel injector 20 and the fuel injector cup 38.

The coupling device 30 can be coupled to the fuel injector 20 by coupling arrangements different from the sealing ring 46 between the fuel injector cup 38 and the fuel injector 20. In an alternative embodiment of the coupling device 30 the inner surface 40 of the fuel injector cup 38 comprises a thread which is in engagement with a thread on the outer surface 28 of the fuel injector body 24 of the fuel injector 20. By this a screw connection between the fuel injector 20 and the fuel injector cup 38 is obtainable.

The fuel injector cup 38 has two protrusions 48 which extend in radial direction relative to the central longitudinal axis L of the fuel injector cup 38. Each of the protrusions 48 has an orifice 52 which is designed to take in a fixing element 50. The fixing element 50 is designed to rigidly couple the fuel injector cup 38 to a cylinder head 54 of the combustion engine 22. The fixing element 50 may be preferably a screw but it may also be of another sort as a pin or a bolt as long as it enables a fixed coupling of the fuel injector cup 38 to the cylinder head 54.

The number of protrusions 48 can be different from two as long as the protrusions 48 allow a rigid coupling of the fuel injector cup 38 to the cylinder head 54 of the combustion engine 22. It may be preferred that the protrusions 48 are circumferentially distributed relative to the central longitudinal axis L of the fuel injector cup 38. By this a well-balanced distribution of the mechanical forces between the fuel injector cup 38 and the cylinder head 54 can be obtained.

Between the fuel injector cup 38 and the cylinder head 54 of the combustion engine 22 a distance element 58 is arranged to enable a defined distance between the fuel injector cup 38 and the cylinder head 54 of the combustion engine 22. Additionally, the distance element 58 is designed to receive the fixing element 50.

Furthermore, between the fuel injector cup 38 and the fuel injector 20 a spring 56 is arranged to apply an axial force on the injector 20 to balance pressure changes in the cylinder head 54 of the combustion engine 22. In a further embodiment the spring 56 may also comprise an orientation means which enables an exact alignment of the fuel injector 20 relative to the fuel injector cup 38. The orientation means may be preferably a tab or a recess which interacts with a respective recess or tab which may be preferably at the fuel injector 20 or at the fuel injector cup 38.

Preferably, additional centering or positioning elements may be arranged between the cylinder head 54 and the fuel injector cup 38 if a particular orientation of the fuel injector 20 or a particular positioning of the fuel injector cup 38 is necessary.

The fuel injector cup 38 and the tube 42 may be preferably made out of stainless steel. This enables to reduce the corrosion of the coupling device 30.

In the following the use of the coupling device 30 for hydraulic coupling of the fuel injector 20 to the fuel rail 18 will be described:

In the case that the fuel rail 18 and the fuel injector 20 are positioned at different places in a combustion engine 22 the coupling device 30 can overcome the distance between the fuel injector 20 and the fuel rail 18.

The tube 32 of the coupling device 30 has a length and a design enabling to overcome the distance between the fuel injector 20 and the fuel rail 18. At the first end 34*a* of the tube 32 the coupling device 30 is coupled to the fuel rail 18 by the metal-metal connection carried out by the coupling nut 36 and the bolt 37. By this a sealingly coupling between the tube 32 and the fuel rail 18 can be obtained. Alternatively, the first end 34*a* of the tube 32 is brazed or welded directly to the fuel rail 18. By this a secure coupling between the tube 32 and the fuel rail 18 is available.

The fuel injector cup 38 is brazed or welded to the second end 30*b* of the tube 32. By this a secure rigid coupling of the fuel injector 38 and tube 32 is obtainable. As the tube 32 can be bended in a way that the fuel injector cup 38 can be coupled to the fuel injector 20 dependent on the position and orientation of the fuel injector 20 relative to the fuel rail 18 a high flexibility of the coupling of the fuel injector 20 to the fuel rail 18 is obtainable by the coupling device 30 comprising the tube 32.

What is claimed is:

1. A coupling device for hydraulically coupling a fuel injector to a fuel rail of a combustion engine comprising a spring;

a fuel injector cup designed to engage a fuel inlet portion of the fuel injector, the fuel injector cup including:

a first portion for engaging a distance element to be positioned between the fuel injector cup and a cylinder head, the distance element being physically distinct from both the spring and the fuel injector cup, the distance element also being uncoupled from the fuel injector such that the fuel injector can translate independent of the distance element; and a second portion for engaging the spring, the spring positioned outside of the fuel injector cup and between the fuel injector cup and a cylinder head;

wherein the distance element is secured between the fuel injector cup and the cylinder head by one or more fixing elements extending at least partially through each of the first portion of the fuel injector cup, the physically distinct distance element, and the cylinder head; and a tube with a first end and a second end, the first end being couplable to the fuel rail and the second end being coupled to the fuel injector cup.

2. The coupling device according to claim 1, wherein the tube is rigid.

3. The coupling device according to claim 1, wherein a coupling nut is coupled to the first end of the tube and is designed to sealingly interact with the fuel rail.

4. The coupling device according to claim 1, wherein the first end of the tube is brazed or welded to the fuel rail.

5. The coupling device according to claim 1, wherein the fuel injector cup is brazed or welded to the second end of the tube.

6. The coupling device according to claim 1, wherein the fuel injector cup comprises a protrusion, the protrusion being designed to enable a rigid coupling of the fuel injector cup to a cylinder head of the combustion engine.

7. The coupling device according to claim 6, wherein the fuel injector cup comprises a plurality of protrusions circumferentially distributed relative to a central longitudinal axis of the fuel injector cup and extending in radial direction relative to the central longitudinal axis of the fuel injector cup.

8. The coupling device according to claim 6, wherein the protrusions comprises orifices being designed to engage fixing elements, the fixing elements being designed to rigidly couple the fuel injector cup to the cylinder head of the combustion engine.

9. The coupling device according to claim 8, wherein the fixing elements are screws engaging the cylinder head of the combustion engine.

10. A fuel supply arrangement comprising a fuel rail being hydraulically coupled to a coupling device, the coupling device comprising:

a spring;

a fuel injector cup being designed to engage a fuel inlet portion of the fuel injector, the fuel injector cup including:

a first portion for engaging a distance element to be positioned between the fuel injector cup and a cylinder head, the distance element, the spring, and the fuel injector cup being physically distinct components; and a second portion for engaging the spring, the spring positioned outside of the fuel injector cup and between the fuel injector cup and a cylinder head;

wherein the distance element is secured between the fuel injector cup and the cylinder head by one or more fixing elements extending at least partially through each of the first portion of the fuel injector cup, the physically distinct distance element, and the cylinder head; and a tube with a first end and a second end, the first end being coupable to the fuel rail and the second end being coupled to the fuel injector cup.

11. The fuel supply arrangement according to claim 10, wherein the tube is rigid.

12. The fuel supply arrangement according to claim 10, wherein a coupling nut is coupled to the first end of the tube and is designed to sealingly interact with the fuel rail.

13. The fuel supply arrangement according to claim 10, wherein the first end of the tube is brazed or welded to the fuel rail.

14. The fuel supply arrangement according to claim 10, wherein the fuel injector cup is brazed or welded to the second end of the tube.

15. The fuel supply arrangement according to claim 10, wherein the fuel injector cup comprises a protrusion, the protrusion being designed to enable a rigid coupling of the fuel injector cup to a cylinder head of the combustion engine.

16. The fuel supply arrangement according to claim 15, wherein the fuel injector cup comprises a plurality of protrusions circumferentially distributed relative to a central longitudinal axis of the fuel injector cup and extending in radial direction relative to the central longitudinal axis of the fuel injector cup.

17. The fuel supply arrangement according to claim 15, wherein the protrusions comprises orifices being designed to engage fixing elements, the fixing elements being designed to rigidly couple the fuel injector cup to the cylinder head of the combustion engine.

18. The fuel supply arrangement according to claim 17, wherein the fixing elements are screws engaging the cylinder head of the combustion engine.

19. A method for hydraulically coupling a fuel injector to a fuel rail of a combustion engine comprising the steps of:

positioning a distance element and a spring between a fuel injector cup and a cylinder head, the distance element and the fuel injector cup being physically distinct components, and the spring being positioned outside of the fuel injector cup;

securing the fuel injector cup to the cylinder head by one or more fixing elements extending at least partially through each of the fuel injector cup, the physically distinct distance element, and the cylinder head, such that the fuel injector cup engages a fuel inlet portion of the fuel injector, wherein the physically distinct distance element physically separates the fuel injector cup from the cylinder head, and coupling a first end of a tube to the fuel rail and a second end of the tube to the fuel injector cup.

20. The method according to claim 19, further comprising the step of coupling a coupling nut to the first end of the tube, wherein the coupling nut is designed to sealingly interact with the fuel rail.

* * * * *